United States Patent [19]

Light et al.

[11] 4,378,642

[45] Apr. 5, 1983

[54] SHOCK-ABSORBING FOOTWEAR HEEL

[75] Inventors: Leon H. Light; Gordon E. Maclellan, both of London, England

[73] Assignee: National Research Development Corporation, London, England

[21] Appl. No.: 196,099

[22] Filed: Oct. 10, 1980

Related U.S. Application Data

[63] Continuation of Ser. No. 922,156, Jul. 5, 1978, abandoned.

[30] Foreign Application Priority Data

Jul. 8, 1977 [GB] United Kingdom ..... 28783/77

[51] Int. Cl.[3] ..... A43B 21/26; A43B 13/18

[52] U.S. Cl. ..... 36/35 R; 36/28; 36/30 R

[58] Field of Search ..... 36/35 R, 35 A, 35 B, 36/28, 29, 30 R, 32, 37

[56] References Cited

U.S. PATENT DOCUMENTS

| | | | |
|---|---|---|---|
| 937,425 | 10/1909 | Daubert | 36/35 R |
| 1,060,751 | 5/1913 | Graham et al. | 36/35 R |
| 1,766,311 | 6/1930 | Shaft | 36/35 R |
| 1,976,389 | 10/1934 | Everston | 36/28 X |
| 2,055,072 | 9/1936 | Everston | 36/28 X |
| 2,402,534 | 6/1946 | Crum | 36/35 R |
| 2,502,774 | 4/1950 | Alianiello | 36/28 |
| 2,998,661 | 9/1961 | Israel | 36/35 R |
| 4,043,058 | 8/1977 | Hollister et al. | 36/28 X |
| 4,101,704 | 7/1978 | Hiles . | |
| 4,130,947 | 12/1978 | Denu | 36/32 R |

FOREIGN PATENT DOCUMENTS

| | | | |
|---|---|---|---|
| 391510 | 9/1965 | Switzerland | 36/35 R |
| 499679 | 1/1939 | United Kingdom . | |
| 517532 | 2/1940 | United Kingdom . | |
| 960877 | 6/1964 | United Kingdom . | |
| 1106741 | 3/1968 | United Kingdom . | |
| 1444091 | 7/1976 | United Kingdom | 36/28 |

OTHER PUBLICATIONS

*The Journal of Bone and Joint Surgery,* vol. 55B, No. 2, May 1973, Stott, J. R. R. et al., "Forces Under the Foot", pp. 335–344.

*Rheumatology and Physical Medicine,* vol. 11, No. 6, 1972, Hutton, W. C. et al., "An Apparatus to Give the Distribution of Vertical Load Under the Foot", pp. 313–317.

*Primary Examiner*—James Kee Chi

*Attorney, Agent, or Firm*—Cushman, Darby & Cushman

[57] ABSTRACT

A shoe or other like article of footwear has a heel construction having higher shock absorbing capability in a rear portion compared to the remainder, this difference resulting from the incorporation in the rear portion of a layer of elastomeric material having a recovery which is delayed, after compression, by a time of an order not less than that during which load through the construction is transferred from the rear portion to the remainder following heel strike during normal walking. This load transfer time is about 40 ms. and the delayed recovery time will not normally exceed about 1s. A similar higher shock absorbancy can be provided additionally in a localized area of the sole.

8 Claims, 6 Drawing Figures

Figure 1:
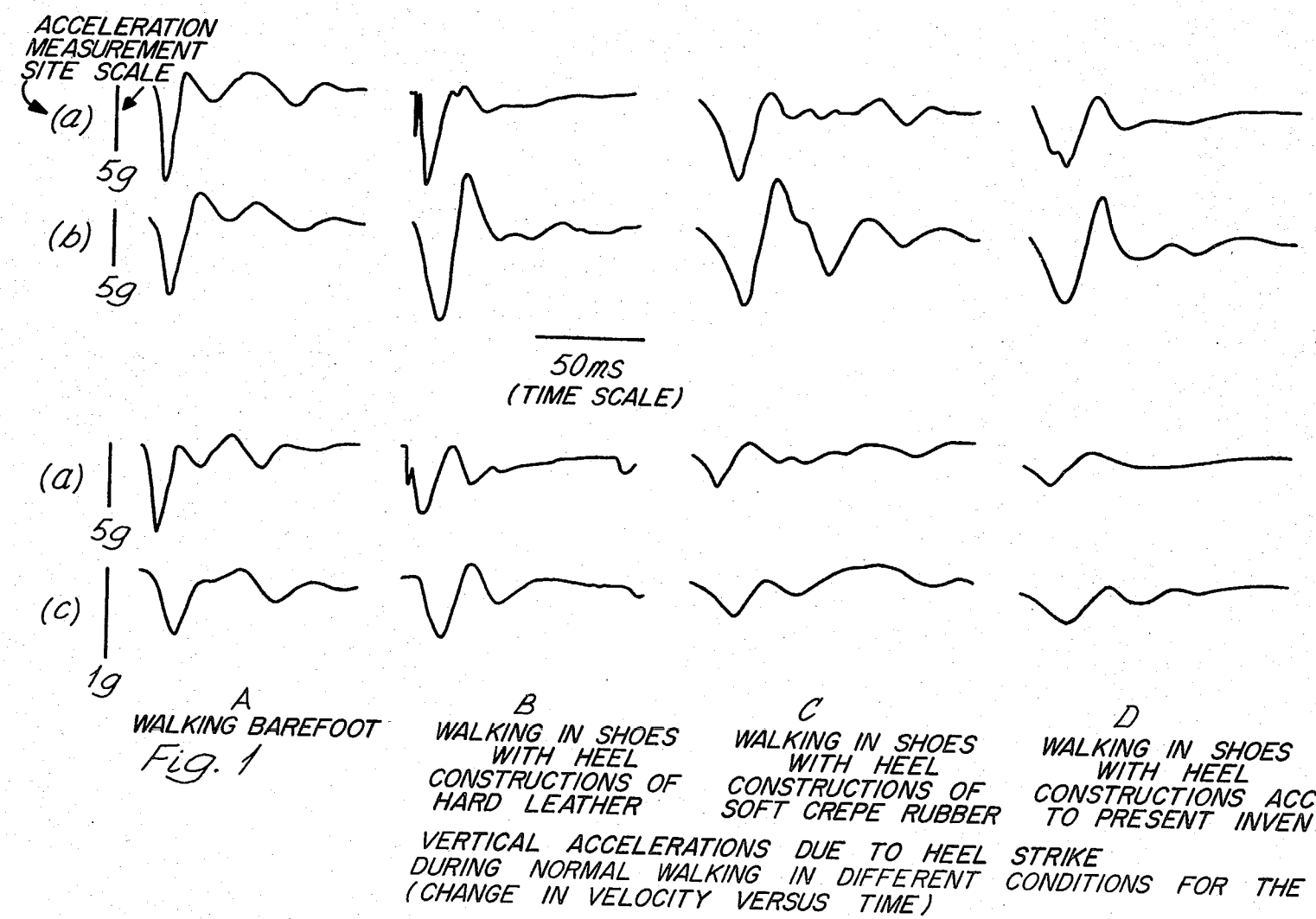

VERTICAL ACCELERATIONS DUE TO HEEL STRIKE DURING NORMAL WALKING IN DIFFERENT CONDITIONS FOR THE HEEL (CHANGE IN VELOCITY VERSUS TIME)

SHOCK-ABSORBING FOOTWEAR HEEL

This is a continuation of application Ser. No. 922,156, filed July 5, 1978, now abandoned.

When a foot first engages the ground after a stride during normal human locomotion, mechanical shock waves are generated and propagated up the skeleton. It has been shown, in research which has led to the present invention, that these shock waves can be substantial, involving high peak accelerations of short duration. For example, heel strike during walking on a hard surface has been shown to produce shock waves involving accelerations up to 8 g, and more rapid locomotion such as running can clearly involve at least similar results.

It is thought that these shock waves can aggravate the symptoms, particularly pain, in a person having a disorder in the spine and/or other joints. Indeed, there is a growing school of thought which suggests that such shock waves may be a contributory factor to such disorders.

The above-mentioned research has additionally shown that the shock waves in question can be modified considerably by the provision of different footwear constructions which ameliorate the above possible undesirable effects.

On the basis of this research, the present invention provides an article of footwear comprising a heel construction having higher shock absorbing capability in a rear portion compared to the remainder thereof, this difference resulting from the incorporation, at least in said rear portion, of a layer of elastomeric material having a recovery which is delayed, after compression, by a time of an order not less than that during which load through said construction is transferred from said rear portion to said remainder following heel strike during normal walking.

The last-mentioned period is up to 40 milliseconds such data being available from FIG. 2 in each of two articles, namely, "Forces under the Foot" by Scott et al in Journal of Bone and Joint Surgery, Vol. 55B, No. 2, May, 1973, and "An Apparatus to Give Distribution of Vertical Load Under the Foot" by Hutton et al in Rheumatology and Physical Medicine, Vol. 11, 1972.

In practice it will normally be desirable that the proposed recovery time has an upper limit so that recovery is substantially completed in the period between successive heel strikes on the construction during normal walking. This period is about 1 second and is readily confirmed by counting while walking.

While the present invention, as so far described, is applicable to footwear in general terms primarily to take account of the shock waves resulting from heel strike during walking, the invention can have further application. More particularly, the invention contemplates the additional provision of a layer of said elastomeric material in other localised areas of the understructure of the relevant article of footwear to provide enhanced shock absorbing capability. One such area corresponds to the ball of the foot to take account of the shock waves which arise when running, and this is especially relevant to sports shoes.

Although this further application of the invention can involve the provision of layers of elastomeric material in discrete areas, it may be appropriate to employ a single layer which extends continuously through and between the relevant areas, with the layer being thickened, perforated, or otherwise differently formed in said areas to provide greater shock absorbing capability therein relative to the intervening area. Also, differential shock absorbing capability may be appropriate as between a heel strike area and a sole strike area, with the latter having a more rapid recovery time than the former.

Initial development of the invention has involved the use of elastomeric materials among those described in U.K. patent applications Nos. 17079/75 and 30881/76 (cognate). Such materials can have a delayed recovery time from 0.7 seconds, which meets the above requirements. However other materials may be suitable, especially such materials having a lower recovery time.

U.K. patent application No. 17070/75 relates to energy absorbing materials, and more particularly to an energy absorbing material suitable for use in car bumpers and other devices intended to provide protection against damage due to impact, shock or collision. The energy absorbing material as disclosed therein comprises an elastomeric layer of polymeric material having a low compression set and a slow recovery. The elastomeric layer should have a low compression set, for example less than 10%, and most preferably less than 5%. In this specification the compression set is defined as the percentage lack of recovery after compression. A suitable polymeric material for the elastomeric layer comprises an elastomeric polyurethane polymer having the following physical properties:

Tensile strength: 50 to 100 lbs. per sq. in.
Elongation to break: 500 to 1200%
Tear strength: 10 to 20 lbs. per linear in.
Compression set: less than 5%
Hardness: 5 (Shore 0—0 scale)

In addition to the above properties, the elastomeric layer should also be stable at temperatures of from −40° C. to +100° C.

Suitable polyurethane polymers for use in the elastomeric layer are those having a low branch molecular weight and a very low degree of cross-linking. Such a polyurethane may be produced for example, by reacting a low molecular weight slightly branched polyol with a relatively small amount of aryl isocyanate such as 4,4'-diaphenylmethane diisocyanate, for example in a weight ratio of from about 12:1 to about 13:1. The isocyanate may if desired be mixed with a diluent, for example methylene chloride. The polyol, which preferably has a molecular weight of from 8000 to 9000, may be prepared by heating a suitable polyester in an autoclave under pressure at a temperature of from about 160° to 250° C. for a period of up to about 8 hours. Very good results have been obtained using a polyol designated PM 515X and supplied by Bostik Limited.

The more difficulty compressible layer is provided in order to absorb energy generated by an impact at higher speeds. In comprises a tough flexible polymeric matrix having a plurality of rigid hollow bodies embedded therein. The physical properties of the polymer matrix are preferably as follows:

Tensile strength: 500 to 3500 lbs. per sq. in.
Elongation to break: 200 to 600%
Tear strength: 120 to 150 lbs. per linear in.

Preferably the polymeric matrix should be stable in the range of −40° C. to +100° C.

In place of the polyurethane polymers mentioned above, it may be possible to use a thermoplastic form of polyurethane, customarily termed a monothane, although this is not preferred due to the necessity of excluding air from its manufacturing process.

U.K. patent application No. 30881/76 relates to an elastomer with quasi-liquid properties and in particular ready deformability and a very slow recovery from deformation due to an applied force, for use in energy absorption. That elastomer comprises a flexible polyurethane of essentially linear structure containing unsatisfied hydroxyl groups, having a compression set less than 15%, an elongation at break of at least 500%, and a recovery which is delayed, after compression, by at least 0.7 sec. Preferably the compression set is less than 5%.

The elastomer of U.K. patent application No. 30881/76 may be made by reacting a substantially linear polyol having hydroxyl end groups and a molecular weight in the range 6000 to 12000, with an isocyanate in less than stoichiometric amount whereby the resulting elastomer contains unsatisfied OH groups.

That elastomer preferably has a hardness, on the Shore 0 0 scale, not exceeding about 50, preferably not exceeding about 20, preferably in the range 0 to 10.

Typical useful polyurethane elastomers according to U.K. patent application No. 30881/76 have an elongation at break preferably exceeding 600%, e.g. about 800%, a tear strength of 5 to 20 lbs./linear inch, particularly 5 to 10 lbs./linear inch; and a tensile strength up to 50 lbs./square inch. The rather low tear strength and tensile strength of such materials can be counteracted by incorporating fibrous material.

In addition to the above properties, the elastomer should also be stable at temperatures of from −40° C. to +100° C.

Suitable polyurethane polymers for the elastomer are those having a low branch molecular weight and a very low degree of cross-linking. Such a polyurethane may be produced for example, by reacting a low molecular weight linear or slightly branched polyol with a relatively small amount of an isocyanate e.g. methyl diisocyanate or an aryl isocyanate such as methylene diisocyanate or 4,4'-diphenylmethane diisocyanate. The chosen isocyanate must be at least as reactive to hydroxyl group as methylene diisocyanate, and examples are toluene diisocyanate, methylene diisocyanate (the preferred one) or triphenyl methyltriisocyanate. The isocyanate may if desired be mixed with a diluent, for example methylene chloride. The polyol should have a molecular weight of from 6000 to 12000, preferably 7000 to 9000, and may be prepared by condensation of a polyglycol, in particular a polyalkylene glycol such as polyethylene glycol or polypropylene glycol, to a molecular weight of between 6000 to 12000. The polyol has hydroxyl end groups, preferably only two OH groups/molecule, and is essentially linear with the minimum of branching. The polyol also may be prepared by heating a suitable polyester in an autoclave under pressure at a temperature of from about 160° to 250° C. for a period of up to about 8 hours. Very good results have been obtained using a polyol designated PM 515X or PM 735X and supplied by Bostik Limited.

The isocyanate and the polyol are reacted together using standard urethane technology, in the complete absence of water and using a suitable catalyst. Triethylene diamine is the preferred catalyst but other tertiary amines are satisfactory. The isocyanate is present in less than the stoichiometrical quantity needed needed to react with the hydroxyl groups, so that not all of the hydroxyl groups are satisfied. The resulting polymer is believed to have foreshortened chains because the polymerisation cannot proceed to completion, with a minimum of chain branching. The resulting solid polymer behaves like a quasi-liquid, being readily deformed by an applied force and slow to recover, although in the absence of such a force it takes up a defined shape and volume.

It is believed that, to achieve the desired physical properties of the material, the polyurethane elastomer should contain 0.002 to 0.004 grams of unsatisfied OH groups per gram of elastomer, preferably 0.0023 to 0.0034 grams OH/gram. To achieve this the mole ratio of OH to NCO in the reactants should be in the range 5:1 to 1.22:1, corresponding to approximately 80% to 55% unsatisfied OH groups in the product.

Certain properties of the elastomer, in particular tensile strength, tear strength, elongation and compression set, can be improved by carrying out the reaction under superatmospheric pressure, for example in the range 50 to 150 psi. This is accompanied by a small increase in hardness. The molecular weight of the polyol is important with respect to the energy absorbing properties of the material since in general below a molecular weight of 6000 the polymer material will suffer permanent deformation and above 12000 the polymer will recover too quickly from an applied force (i.e. with a delay less than 0.7 sec.).

Fillers may be added to stiffen the material. Hydrocarbons may be added as a diluent during polymerisation by up to 10% by weight of the polyol to reduce the surface tack of the finished polymer.

It has been found that surface tack can be reduced and abrasion resistance increased by the incorporation of a small amount of silicone polycarbinol, in particular a polypropylene oxide-silicone copolymer. Normally such additives are present at over 2% by weight of the polyol, but such amounts are ineffective in the elastomer of the invention; instead, amounts less than 2%, preferably 0.5% to 1%, are effective in the elastomer of the invention and improve both surface tack and abrasion resistance.

Examples of specific elastomers according to U.K. patent application No. 30881/76 and their manufacture will now be given.

Table 1 lists four different reaction mixtures A to D each of which was polymerised at atmospheric pressure and also at 80 psia so that in all eight different products were obtained. The physical properties of each of these products are listed in Table 1.

Each mixture consisted of the same linear polyol Bostik PM 735X, of molecular weight 7000–9000 (determined by measurement of the hydroxyl number), based on polypropylene glycol. This polyol contained 0.7% to 2% triethylene diamine as catalyst. In was placed in a glass vessel with the methyl diisocyanate and the polypropylene oxide-siloxane copolymer, at 20° C., and the mixture stirred for 20 sec. Polymerisation took 1 to 20 min. according to the proportion of catalyst present. With 2% catalyst there was a noticeable viscosity increase after 60 sec., gelation occurred in 4 min. and the material was solid after 8 minutes, whereafter it could be removed from the vessel or mould. Heat was evolved, raising the temperature to as much as 80° C.

In the product, 65% of the original OH groups remain unsatisfied, corresponding to 0.0028 gm OH per gram of product.

The quantities of the constituents are given in parts by weight (ppw). It will be seen that a reduction in the proportion of polyol leads to an increase in hardness, tensile strength and tear strength but reduces the elongation and recovery delay time after compression, and increases the compression set. Polymerisation under pressure also increases hardness and strength but increases the elongation and reduces compression set.

The maintenance of low compression set at low temperatures is to be noted. Flexibility is also maintained: a sample 10" by 0.5" by 0.25" was kept at −40° C. for 24 hours; it could then be wrapped around a mandrel of 3" diameter without cracking. The material also withstands the impact test without cracking, at −40° C. and 75° C. The softening temperature depends somewhat on the formulation and polymerisation conditions but is typically in the range 90° C. to 120° C.

diisocyanate, 100 ppw polyol. The water preferably has a pH greater than 7. A 6-fold volume increase can be attained. The foam produces greater rebound than the solid material, but much less than conventional polyurethane foam, as shown in Table 4 below:

TABLE 4

| Lupke pendulum test, sample thickness 12.5 mm: | |
|---|---|
| Material | % Rebound Resilience |
| foam LCS (relative density 0.33) | 12 |
| neoprene foam | 44 |
| natural rubber foam | 32 |
| polyurethane foam | 38 |

TABLE 1

| | | SAMPLE A | | SAMPLE B | | SAMPLE C | | SAMPLE D | |
|---|---|---|---|---|---|---|---|---|---|
| | Units | Atmospheric pressure | 80 psi | Atmospheric Pressure | 80 psi | Atmospheric Pressure | 80 psi | Atmospheric pressure | 80 psi |
| Chemical Composition | | | | | | | | | |
| Polyol | ppw | 21.25 | | 20.75 | | 20.50 | | 20.25 | |
| Polypropylene oxide - Siloxane copolymer | ppw | 0.16 | | 0.14 | | 0.13 | | 0.12 | |
| Methyl diisocyanate (86% pure) | ppw | 1.00 | | 1.00 | | 1.00 | | 1.00 | |
| Physical Properties | | | | | | | | | |
| Hardness (40 hrs) | Shore '00' | 8 | 10 | 18 | 20 | 35 | 38 | 40 | 42 |
| Density | gm/cc | 1.34 | 1.34 | 1.34 | 1.34 | 1.34 | 1.34 | 1.34 | 1.34 |
| Ultimate tensile strength | psi | 14 | 18 | 18 | 21 | 24 | 30 | 40 | 45 |
| Elongation at break | % | 800 | 900 | 720 | 840 | 680 | 700 | 640 | 650 |
| Tear Strength | lb/linear" | 5.0 | 5.9 | 5.5 | 6.4 | 6.3 | 6.9 | 6.8 | 7.6 |
| Compression set at +22° C. | % | 4 | 0 | 13 | 0 | 13 | 1 | 13 | 1 |
| Compression set at −40° C. | % | 5 | 0 | 14 | 0 | 14 | 1 | 14 | 2 |
| Impact (.5 lb bail at 6ft) | — | no crack | no crack | no crack | no crack | no crack | no crack | no crack | no crack |
| Complex modulus phase shift | °C./decade | | | 20 | 22 | | | | |
| Recovery delay | secs | 2.0 | 2.0 | 1.5 | 1.5 | 1.0 | 1.0 | 1.0 | 1.0 |

The recovery delay was determined from dynamic measurements of the complex modulus phase shift, showing substantial recovery after 2 to 3 sec. (Sample A) and complete recovery after 100 sec.

The material is chemically and dimensionally stable, with good resistance to water, ozone, oil, petrol and ethylene glycol.

The impact-absorbing properties of the elastomer were investigated by the Lupke (BS 903) pendulum rebound test. Table 2 compares a specimen of the elastomer of the invention (L C S). It can be seen that the elastomer is "dead".

TABLE 2

| LUPKE PENDULUM AT 20° C. | | |
|---|---|---|
| MATERIAL | HARDNESS (TRHD) | REBOUND RESILIENCE % |
| Natural rubber | 52 | 69 |
| Butyl | 46 | 13 |
| SBR (Styrene butadiene rubber) | 53 | 34 |
| Nitrile | 57 | 32 |
| EPDM (Ethylene propylene elastomer) | 53 | 48 |
| Neoprene | 62 | 57 |
| Silicone | 53 | 42 |
| "Viton" fluorinated rubber | 72 | 5 |
| LCS | less than 1 | 0 |

The foregoing description and in particular the numerical values of physical properties relate to the solid elastomer of U.K. patent application No. 30881/76. However as described therein the elastomer can readily be produced in foam form e.g. by the addition of water and methyl diisocyanate to react with the water, for example in the proportions 6 ppw water, 8 ppw methyl The disclosures in the two aforementioned U.K. patent applications were combined into a single U.K. patent application, corresponding to U.S. patent application, Ser. No. 681,528, filed Apr. 29, 1976, which in turn, became U.S. Pat. No. 4,101,704, issued July 18, 1978.

Figure 2A:
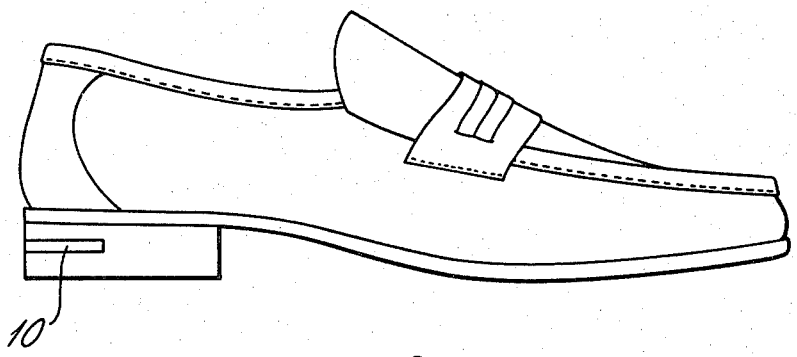
Figure 2B:
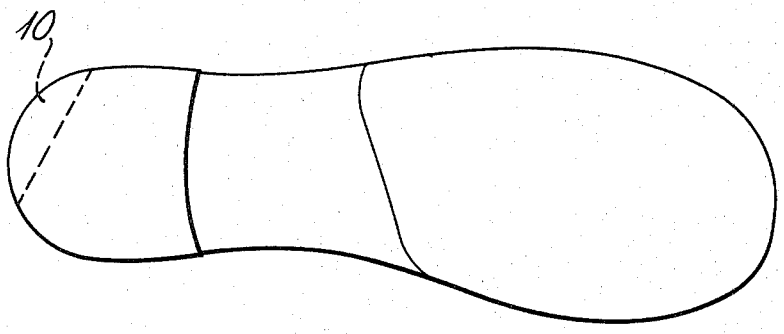

A comparative illustration of the results of the invention is provided by the accompanying drawings, in which:

FIG. 1 graphically presents vertical acceleration transients due to heel strike during normal walking in different conditions for the heel, FIGS. 2*a* and 2*b* illustrates one form of footwear according to the invention as used in obtaining the results of FIG. 1.

Figure 3:
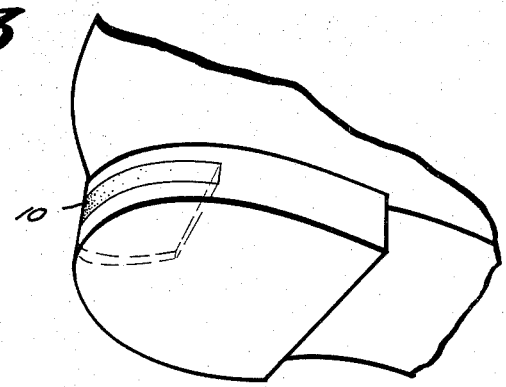
Figure 4:
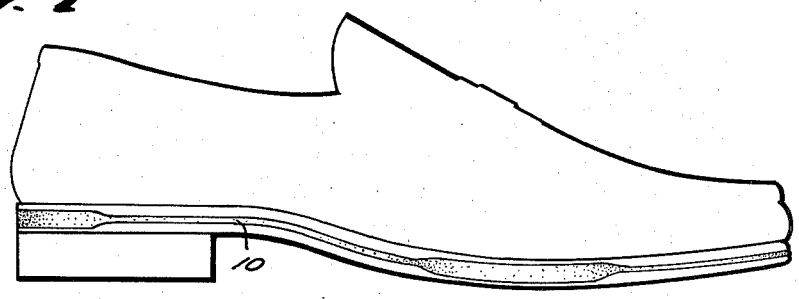
Figure 5:
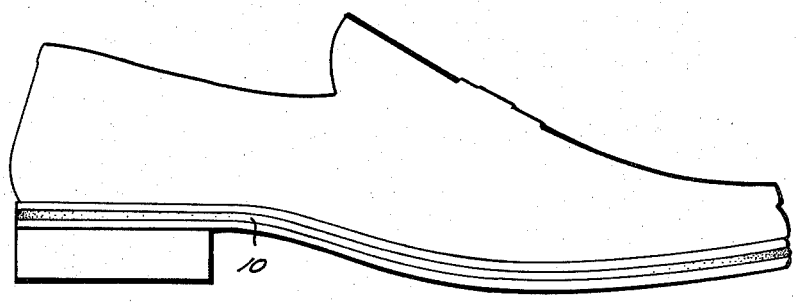

FIGS. 3, 4 and 5 illustrate further forms of footwear provided with shock-absorbing heels according to the present invention.

The graphs of FIG. 1 are in two pairs of rows denoted (a) and (b), and (a) and (c), to indicate different measurement sites, and in four columns denoted A, B, C and D to indicate different conditions. The relevant measurements at sites (a), (b) and (c) were obtained by way of transducers connected to bone pins driven into the tibia 5 cms. below the tibial tubercle, attached to a spreader plate of foamed polyethylene glued and strapped to the skin 15 cms. lower down the tibia, and forming part of a bite-bar held between the teeth, respectively. The different conditions A to D respectively involved walking barefoot, and walking in shoes with heel constructions of hard leather, soft crepe rubber, and a shock absorbing form as illustrated by FIGS. 2*a* and 2*b*. The measurements were taken simultaneously for each pair, but not at all three sites, and this explains slight differences between the two rows (a) for corresponding conditions in FIG. 1.

The graphs of FIG. 1 show a marked improvement during employment of the invention compared to the other conditions particularly that involving a crepe rubber heel construction. This last construction might otherwise be considered, together with other elastomers conventionally used in footwear constructions, as suitable to reduce the undesirable effects of heel strike, but this is not so since such materials generally have too short a recovery time and are seen from FIG. 1 to produce significant reverberations after the initial transient of heel strike.

FIG. 2*a* illustrates a shoe in respective side elevation and FIG. 2*b* illustrates in underneath plan view the same shoe, in which the heel incorporates a layer of elastomeric material according to the above-mentioned applications. The relevant layer is denoted at 10 and takes the form of an insert producing a laminated heel construction, and insert extending only into a rear portion of the heel. The insert extends forwardly no more than half, and preferably no more than one third of the heel length. Also, the layer can be further localised in the area normally subjected to heel strike by orientation, as shown, into the outer rear quarter of the shoe. The layer in the embodiment employed in connection with FIG. 1 was 8 mm. thick and was made of material closely corresponding to Samples C and D of the above-mentioned Applications.

Other forms of the invention than that of FIGS. 2*a* and 2*b* also possible. In one such form as shown in FIG. 3 the layer 10 is of wedge shape with its thicker edge at the periphery of the heel. In another form as shown in FIG. 4 the layer 10 can be extended further or wholly across the heel, or indeed into the whole, with the layer being locally thickened in the original area of the layer 10 in FIGS. 2*a* and 2*b*. A further form as shown in FIG. 5 can comprise a similarly extended layer but with localised modification of the shock absorbing capability in the relevant heel area by perforating the layer. Also, as noted earlier, an extended form of the layer 10 can provide enhanced shock absorbing capability in an additional localised area such as below the ball of the foot. Lastly, it is not essential that the layer 10, or an equivalent extended layer, be incorporated in the main body of the heel or under-structure of the shoe since the layer can be located at the lowermost level of the shoe if the elastomeric material can be provided with suitable wear-resistant properties, or the material may be provided with a skin or secondary layer having such properties.

We claim:

1. An article of footwear, comprising:

a heel construction having a higher shock absorbing capability in a rear portion compared to the remainder thereof, this difference resulting from the incorporation, at least in said rear portion, of a layer of substantially non-cellular elastomeric material having a low compression set of less than 5 percent and a recovery which is delayed, after compression, by a time of an order not less than that during which load through said construction is transferred from said rear portion to said remainder following heel strike during normal walking;

said recovery time being within the range of 40 milliseconds to one second.

2. An article according to claim 1 wherein said layer extends no more than half way forwardly across said heel construction.

3. An article according to claim 2 wherein said layer extends no more than a third of the way forwardly across said heel construction.

4. An article according to claim 2 wherein said layer is incorporated as an insert producing a laminated heel construction.

5. An article according to claim 4 wherein said insert is wedge-shaped and has its thicker parts adjacent the periphery of said heel construction.

6. An article according to claim 1 wherein said heel construction is constituted by an under-structure which further comprises a sole, said article incorporating a further layer of said elastomeric material in the under-structure of said article to provide greater shock absorbing capability in a localised area of the sole.

7. An article according to claim 1 wherein said heel construction is constituted by an under-structure which further comprises a sole, said article wherein said layer is extended forwardly through the under-structure of said article and is thickened in said heel rear portion and a localised area of the sole to provide greater shock absorbing capability than elsewhere.

8. An article according to claim 1 wherein said heel construction is constituted by an under-structure which further comprises a sole, said article wherein said layer is extended forwardly through the under-structure of said article and is perforated in said heel rear portion and a localised area of the sole to provide greater shock absorbing capability than elsewhere.

* * * * *